United States Patent [19]

Nagy

[11] Patent Number: 4,860,932

[45] Date of Patent: Aug. 29, 1989

[54] BOTTLE SIPHON AND DISPENSER

[76] Inventor: Imre Nagy, 2733 Columbine St., San Diego, Calif. 92105

[21] Appl. No.: 199,423

[22] Filed: May 27, 1988

[51] Int. Cl.[4] ..... B65D 83/00

[52] U.S. Cl. ..... 222/402.1; 222/505; 222/518

[58] Field of Search ..... 215/4–5; 222/204, 394, 399, 416, 464, 505, 509, 511, 518, 402.25, 402.1

[56] References Cited

U.S. PATENT DOCUMENTS 3,618,833 11/1971 Webster ..... 222/402.22
4,671,436 6/1987 Hagan ..... 222/518 X

FOREIGN PATENT DOCUMENTS 2537092 6/1984 France ..... 222/518
19239 of 1910 United Kingdom ..... 215/4
30134 of 1910 United Kingdom ..... 215/4

*Primary Examiner*—Michael S. Huppert
*Attorney, Agent, or Firm*—Charmasson & Holz

[57] ABSTRACT

A container seal and siphon tube outlet combination where a sealing bias is provided by a ported leaf type spring which is also oppositely reacting against and biasing closed a manually operated poppet valve. The leaf spring is generally concave circular disk with a non-circular port in the center. The port is shaped to include fingers extending axially and radially inward, tending to keep the port open. The siphon tube is also sealed by the bottle cap seal. The manual actuation is accomplish by a lever applying force to the poppet against the spring bias.

8 Claims, 1 Drawing Sheet

2
14
16
11
10
7
9
13
12
8
5
10
15

2
14
2
9
7
8
5
3
6
4
2

BOTTLE SIPHON AND DISPENSER

FIELD OF THE INVENTION

This invention relates to fluid dispensers, more specifically to pressurized or carbonated beverage bottle containers and dispensing means.

BACKGROUND OF THE INVENTION

Many pressurized fluids are transported in large multiple serving or fluid usage containers which may be inconvenient for dispensing single servings of the fluids. Once opened, these containers may also allow pressure or carbonation to decay unless released. Fluid dispensers have been developed allow multiple dispensing and resealing of these containers.

The primary objectives of a pressurized fluid dispenser are to (1) quickly attach to the container and seal the pressurized fluid(s) within the container, (2) provide a means to variably dispense the pressurized fluid, (3) control the maximum flow to within a prescribed amount, (4) reseal remaining contents under pressure after dispensing and allow convenient dispenser removal when container is emptied of fluid(s). The dispenser typically includes a siphon tube to draw only pressurized liquid from the bottom of the bottle when the bottle is upright. The siphon and dispenser should be small so that they will fit near or through the neck of the bottle. They should also be light weight, rugged in construction, pleasing in appearance and low in cost. When the dispenser is used in each of the operating modes (attachment/removal, storage, dispensing and resealing), a minimum of effort to convert from one mode to another mode is also desirable.

Most of the current dispensers may accomplish one or more of these operating modes and meet some objectives very well, but have difficulties with others. The common approach is to provide a container or bottle closure/capping means attached to a siphon and a separate hand operated valve near or within the neck or other portion of the bottle. Although the valve, siphon and bottle closure may be nearby one another, they are distinct. No common element, other than structural support, is present in the valve, siphon and bottle closure. Separate and distinct valves used in dispensers include: ball or needle valves (as illustrated in U.S. Pat. No. 1,246,213), poppet valves (as illustrated in U.S. Pat. No. 1,372,968), and pinch or flapper valves (as illustrated in U.S. Pat. Nos. 2,876,937 and 3,782,430). Flow control is typically provided by a flow control orifice within the valve, which restricts the maximum flow so that excessive liquid is not dispensed (avoiding splash and spillage). In some of these applications, the valve is placed separately from the bottle neck or opening (as illustrated in U.S. Pat. No. 1,246,213). Some of these applications also include the provision for recharging of the gas within the bottle or container (adding pressure).

These separate valve, orifice, siphon and container closure prior art approaches tend to be more complex and cumbersome than necessary, limiting transport, access and use. These prior approaches have many other limitations. These are primarily related to the multiplicity of elements required to accomplish the operating modes, creating added cost, weight and space. This multiplicity of elements, added weight and space particularly detract from the reliability of the dispenser, which may be a primary consideration.

No prior art in this field that the applicant is aware of has combined the functions of a bias element acting on a valve port obstructor and a bottle port seal. No prior art in this field that the applicant is aware of has combined the functions of a flow control or balancing orifice and bias element in a simple and economical device that could be conveniently reused in connection with disposable carbonated beverage bottles.

SUMMARY OF THE INVENTION

The principal and secondary objects of the invention are:

To provide a siphon and dispensing means having fewer separate elements which can be used repeatedly with disposable carbonated beverage containers;

To provide a reliable sealing and resealing of the container and valve; and

To provide an easy to operate dispensing mechanism. These and other objects are achieved by a dispenser body housing a fluid passage, poppet valve and a container seal, and a siphon tube outlet combinations where the sealing bias is provided by a ported leaf type spring which oppositely reacts against and closes a manually operated poppet. The leaf spring is generally circular with a flow control port in the center. The port also includes fingers extending inward tending to keep the port open as the valve obstructor is opened. The siphon pierces the bottle seal to contain fluids within the siphon and fluid passage. Manual actuation is accomplished by a lever forcing the poppet further into the leaf spring, opening the valve.

DESCRIPTION OF THE PREFERRED EMBODIMENT

Figures 1, 2, 3:
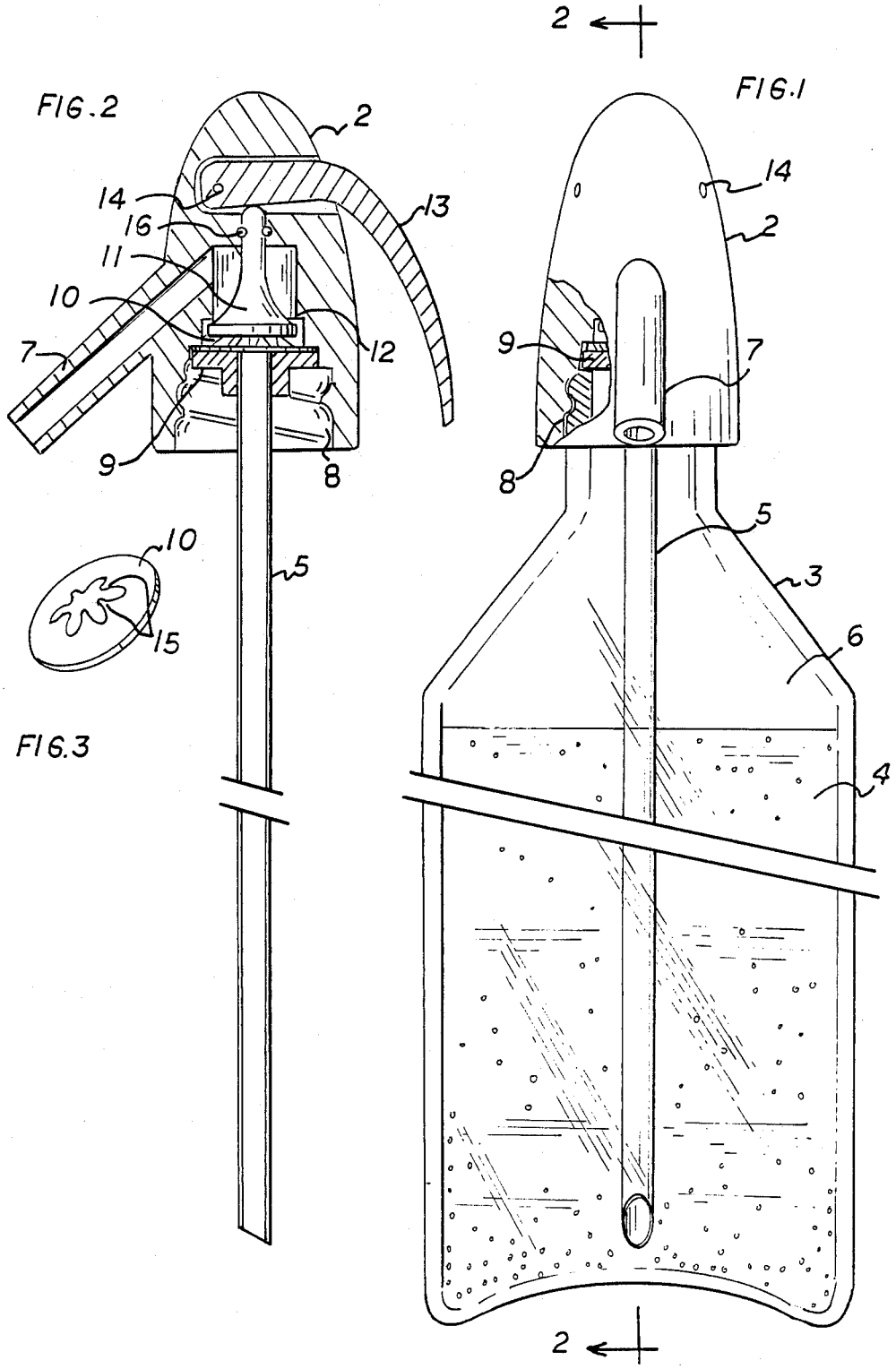
FIG. 1 shows a front view of a carbonated beverage bottle and dispenser.
FIG. 2 shows a cross sectional side view of the siphon and dispenser.
FIG. 3 shows a perspective view of the ported leaf spring bias element.

FIG. 1 shows a front view of a carbonated beverage bottle and dispenser. The dispenser body 2 is screwed to the neck or port of a common disposable carbonated beverage bottle 3. The container or bottle 3 is usually made from a transparent glass or plastic material which allows a user to determine how much liquid 4 remains in the bottle. The liquid may be soda water, soda pop or any other carbonated beverage. A siphon or hollow tube 5 is provided to draw liquid from the bottom of the bottle 3. Pressure is provided by a gas 6 in the ullage or space above the liquid 4. Because of the larger specific gravity of the liquid 4 compared to the gas 6, the liquid 4 displaces any gas 6 at the bottom of the bottle 3. The dispenser discharge port 7 opens away from and down to fill a glass or other receptacle (not shown for clarity). Liquid is discharged by opening a valve (not shown on FIG. 1 for clarity), allowing the gas pressure to force the liquid 4 through and up the siphon 5 and out dispenser discharge port 7.

The neck of bottle 3 as shown in the cutaway portion, is threaded and matches the female or inside threads 8 at the base of the dispenser body 2. A bottle seal 9 is attached to the dispenser body 2 and act against the rim of the opening or port of the bottle 2 in order to seal the contained fluid.

FIG. 2 shows a cross sectional side view (2—2 in FIG. 1) of the siphon and dispenser. The dispenser body 2 is provided with threads 8 matching the top of the bottle 3 (not shown for clarity). As the top of bottle 3 is threadably engaged, the rim of the bottle opening comes into contact with the seal 9 within the dispenser body 2. The bottle seal 9 is made from an elastomeric material and engages the upper end of the siphon 5. The attachment of the siphon 5 to the bottle seal 9 may be by means of adhesive or mechanical (ie: press fit) means. The threaded or removably attached dispenser body 2 and bottle interface provides a portion of the force required to seal the fluid contents within the bottle. Additional force is provided by a ported disc or leaf spring 10 bearing on the surface of the bottle seal opposite from the port of the bottle 3. The bias or spring 10 forces on the bottle seal are reacted by obstructor or valve poppet 11. The obstructor is shown sealing or obstructing the flow past the valve port 12. The poppet 11 is displaced by manually displacing or pushing lever 13 which is mounted on pivot 14 which translates obstructor 11 downward. The obstructor 11 is slidably mounted to the dispenser body 3 by bearing 14. Downward displacement of obstructor 11 moves the interfacing surface away from the valve seat 12, allowing liquid to flow up the siphon 5 through the ported disk spring 10, around obstructor 11, past valve seal 12 and into the dispenser discharge port 7. The ported disk or beveled spring provides multiple passages for the flow of fluids by means of flow around fingers 15 extending out to contact and bias the obstructor 11. An "O" ring 16 provides a water-tight seal and bearing around the shaft of the obstructor 11.

The female threads of dispenser body 2 allow the dispenser and siphon device to be attached to a carbonated beverage bottle with a twist off cap (cap not shown for clarity). An alternate configuration would provide for removable attachment of the dispensing/siphon device to a carbonated beverage bottle with a pop off cap on a rim of the bottle port. The dispenser/siphon device allows storage of the partially dispensed beverage under pressure, further dispensing of the beverage without loss of gas and resealing without the need for a cap. Dispensing from large beverage bottles is made more convenient and the risk of dropping and spillage is reduced. If the dispenser is attached to the bottle when fluid is chilled, the liquid contents can be dispensed as the contents warm slightly after the dispenser is attached.

FIG. 3 shows a perspective view of the ported leaf spring bias element 10. The fingers 15 and remainder of bias element 10 form a concave down shape, with fingers projecting inward and upward. The bias element is made from an strong elastic material such as spring steel. Valve opening force on lever 13 forces obstructor 11 to depress fingers 15, while maintaining orifice or control port area around the fingers. Large opening forces on disc element 10 will reduce the flow area around the fingers 15 limiting and controlling discharge of the pressurized fluids.

While the preferred embodiment of the invention has been shown and described, changes and modifications may be made therein within the scope of the appended claims without departing from the spirit and scope of this invention.

What is claimed is:

1. A fluid dispenser and siphon device in combination with a container having a container port and holding pressurized fluids, said device comprising:

a dispenser body removably attached to said container proximate to said container port, said dispenser body having an inlet port proximate to said container port when said body is attached to said container, a fluid discharge port and a fluid passage from said inlet port to a said discharge port;

a sealing element attached to said fluid passage proximate to said inlet port, shaped and positioned to contact and seal said container port;

a hollow tube, extending from a bottom region within said container to said inlet port said hollow tube providing a fluid path from said bottom region through said sealing element to said fluid passage;

a valve seat within said fluid passage;

an obstructor shaped and dimensioned to block the flow of pressurized fluid through said fluid passage when said obstructor is in a first sealing position in contact with said valve seat, and to allow flow of pressurized fluid when moved to at least one other position within said fluid passage;

means for moving said obstructor from one of said obstructor positions to another; and a ported bias element having fluid port dimensions smaller than said fluid passage, having a first surface in contact with and tending to seal said sealing element against said container port and a second surface, distal from said first surface, in contact with said obstructor and tending to move said obstructor toward said first sealing position.

2. The device claimed in claim 1, wherein said means for moving comprises:

a shaft element attached to said obstructor;

a shaft bearing in said dispenser body, retaining said shaft element and allowing sliding motion of said shaft during translation of said obstructor from one said position to another; and a lever pivotally attached to said dispenser body, having a surface capable of contacting one end of said shaft, shaped and dimensioned to allow manual motion of said lever around said pivot to translates said obstructor from said first position to said another position.

3. The device as claimed in claim 2, wherein said dispenser is removably attached to said container by external threads on said container and matching threads on said dispenser body.

4. The device as claimed in claim 3, wherein said container is made of a transparent glass material.

5. The device as claimed in claim 4, wherein said bearing includes an "O" ring.

6. A fluid dispenser and siphon device in combination with container having a container port and holding pressurized fluids, said device comprising:

a dispenser body removably attached to said container proximate to said container port, said dispenser body having an inlet port proximate to said container port when said body is attached to said container, a fluid discharge port and a fluid passage from said inlet port to a said discharge port;

a sealing element attached to said fluid passage proximate to said inlet port, shaped and positioned to contact and seal said container port;

a hollow tube extending from a bottom region within said container to said inlet port said hollow tube providing a fluid path from said bottom region through said sealing element to said fluid passage;

a valve seat within said fluid passage;

an obstructor shaped and dimensioned to block the flow of pressurized fluid through said fluid passage when said obstructor is in a first position in contact with said valve seat, and to allow flow of pressurized fluid when moved to at least one other position within said fluid passage;

means for moving said obstructor from one of said obstructor positions to another;

a ported bias element having fluid port dimensions smaller than said fluid passage, having a first surface in contact with and tending to seal said sealing element against said container port and a second surface, distal from said first surface, in contact with said obstructor and tending to move said obstructor toward said first position; and wherein said bias element comprises a concave disc shaped leaf spring having a central port crowned by a plurality of fingers extending axially and radially inward from the outward portions of said spring, said fingers capable of biasing said obstructor.

7. The device as claimed in claim 6, wherein the area around said central port is shaped and dimensioned to act as a flow control orifice for fluids being dispensed.

8. A liquid dispensing device for liquids held under gaseous pressure within a container having an outlet at the top of the container when resting on a horizontal surface, said device comprising:

a dispenser cap fastened to said outlet for hermetically sealing said container, having a fluid inlet port and a fluid discharge port;

a gas tight gasket at the entrance to said inlet port, said gasket capable of covering said outlet, except for one opening in said gasket;

a siphon inserted through said opening, said siphon having external dimensions and shape matching said opening in said gasket, said siphon extending from proximate the bottom of said container through said gasket to said cap inlet;

means for obstructing liquid flow; and one bias element proximate said cap tending to seal said means for obstructing liquid flow, and said bias element also tending to seal said gasket further against said outlet.

* * * * *